US005810196A

United States Patent [19]

Lundy

[11] Patent Number: 5,810,196

[45] Date of Patent: Sep. 22, 1998

[54] PAINT BUCKET

[76] Inventor: Michael J. Lundy, 2718 W. Onza Cir., Mesa, Ariz. 85202

[21] Appl. No.: 814,666

[22] Filed: Mar. 11, 1997

[51] Int. Cl.[6] ..... B65D 25/04

[52] U.S. Cl. ..... 220/736; 220/23.83; 220/23.8; 220/505; 220/570

[58] Field of Search ..... 220/23.83, 23.86, 220/23.8, 505, 501, 570, 555, 697, 735, 736

[56] References Cited

U.S. PATENT DOCUMENTS

| | | | |
|---|---|---|---|
| 1,590,572 | 6/1926 | Fredette | 220/505 |
| 2,705,334 | 4/1955 | Farrow | 220/505 |
| 2,896,809 | 7/1959 | Metzger et al. | 220/23.8 |
| 3,581,904 | 6/1971 | Selby . | |
| 3,688,943 | 9/1972 | Brown . | |
| 4,145,789 | 3/1979 | Morgan, Sr. | 220/570 |
| 4,164,299 | 8/1979 | Fuhr . | |
| 4,266,686 | 5/1981 | Carter . | |
| 4,436,217 | 3/1984 | Ritter . | |
| 4,583,666 | 4/1986 | Buck . | |
| 4,865,282 | 9/1989 | Yonkman et al. | 220/697 |
| 4,969,617 | 11/1990 | Desjardins . | |
| 5,322,183 | 6/1994 | Strachan . | |
| 5,405,030 | 4/1995 | Frazier | 220/505 |
| 5,511,279 | 4/1996 | Ippolito | 220/570 |
| 5,549,216 | 8/1996 | Scholl | 220/736 |

*Primary Examiner*—Stephen J. Castellano
*Attorney, Agent, or Firm*—Parsons & Goltry; Robert A. Parsons; Michael W. Goltry

[57] ABSTRACT

A receptacle for holding a viscous mass and for providing intermittent storage of an implement for spreading the viscous mass upon a surface, the receptacle comprising a continuous sidewall having a closed lower end and extending upwardly therefrom and terminating with a primary rim defining an opening communicating with a chamber bound by the continuous sidewall, the continuous sidewall including a primary sidewall having the primary rim and a secondary sidewall having a secondary rim located at a point subjacent the primary rim, and an auxiliary container including a bottom panel extending outwardly from the secondary panel at a point subjacent the secondary rim and an auxiliary sidewall extending outwardly from the secondary sidewall and extending upwardly from the bottom panel and terminating with an auxiliary rim located at a point proximate the primary rim, wherein the bottom panel and portions of the auxiliary sidewall and the secondary sidewall subjacent the secondary rim define a well communicating with the chamber and for holding the implement when not in use.

6 Claims, 2 Drawing Sheets

PAINT BUCKET

BACKGROUND OF THE INVENTION

1. Field of the Invention

This invention relates to receptacles.

More particularly, this invention relates to receptacles for holding viscous masses.

In a further and more specific aspect, the instant invention relates to a receptacle for holding a viscous mass and for holding an implement for spreading the viscous mass upon a surface.

2. Prior Art

Painting, such as the interior walls of a house, frequently requires the use of implements such as a roller to cover large surfaces and a brush for trim or corners. Also, there must be a container for the supply of the paint. This presents certain problems of inconvenience.

For instance, during the painting process, it has been noticed that during use of either the roller or the brush, the user is presented with the problem of where to store the implement not being used. In regards to the brush, while it is desirable to keep the lower portion of the bristles in paint to prevent drying, it is not desirable to submerge it in the container of paint. Rollers are generally provided with a hook integral with the handle to be suspended within the container. In addition, it is desirable to remove a portion of the paint from the brush and the roller immediately prior to use, all of which provide needs not provided with prior art devices.

It would be highly advantageous, therefore, to remedy the foregoing and other deficiencies inherent in the prior art.

Accordingly, it is an object of the present invention to provide and new and improved receptacle for holding a viscous mass and for storing an implement for spreading the viscous mass upon a surface.

Another object of the present invention is to provide a receptacle that is easy to use.

And another object of the present invention is to provide a receptacle that is easy to construct.

Still another object of the present invention is to provide a receptacle that is inexpensive.

Yet another object of the present invention is the provision of increasing the efficiency and ease of intermittently storing an implement such as a brush or a roller during painting or other similar activities involving the application of a viscous mass to a surface.

Yet still another object of the present invention is to the provision of preventing an implement such as a brush or a roller from drying out when not in use for a period of time.

And a further object of the present invention is to provide a receptacle that may be easily transported from place to place.

And yet a further object of the present invention is to provide a receptacle having an element for allowing a user to remove excess paint from an implement such as a brush and/or a roller.

SUMMARY OF THE INVENTION

Briefly, to achieve the desired objects of the instant invention in accordance with a preferred embodiment thereof, provided is a receptacle for holding a viscous mass and for providing intermittent storage of an implement for spreading the viscous mass upon a surface. The receptacle includes a continuous sidewall having a closed lower end and extending upwardly therefrom and terminating with a primary rim defining an opening communicating with a chamber bound by the continuous sidewall. The continuous sidewall includes a primary sidewall having the primary rim and a secondary sidewall having a secondary rim located at a point subjacent the primary rim, and an auxiliary container. The auxiliary container includes a bottom panel extending outwardly from the secondary panel at a point subjacent the secondary rim and an auxiliary sidewall extending outwardly from the secondary sidewall and extending upwardly from the bottom panel and terminating with an auxiliary rim located at a point proximate the primary rim. The bottom panel and portions of the auxiliary sidewall and the secondary sidewall subjacent the secondary rim define a well communicating with the chamber and for holding the implement when not in use.

The present invention may further include a planar screen including an upper edge having a pair of hooks operative for detachably engaging the secondary rim of the secondary sidewall and extending downwardly therefrom and terminating with a lower edge to bear against closed lower end of the receptacle at a point spaced from the secondary panel. Prior to use, a user may wipe an implement along planar screen to remove excess viscous mass therefrom for deposit within the chamber of receptacle prior to applying the viscous mass to a selected surface.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
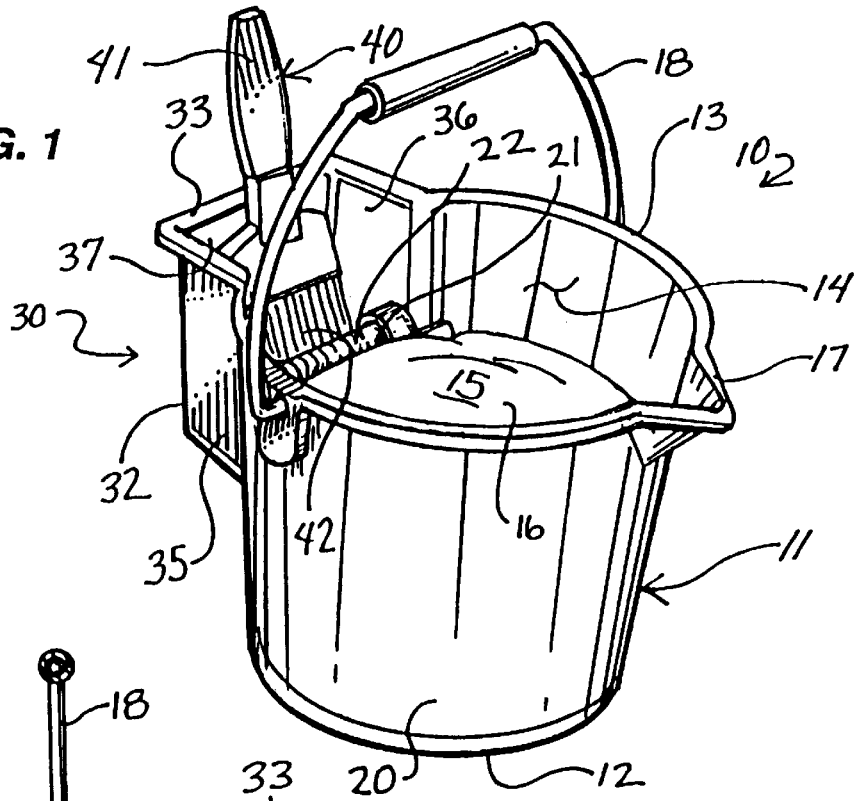
FIG. 1 is a perspective view of a receptacle for holding a viscous mass and for providing intermittent storage of an implement for spreading the viscous mass upon a selected surface, in accordance with a preferred embodiment of the present invention.

Turning now to the drawings, in which like reference characters indicate corresponding elements throughout the several views, attention is first directed to FIG. 1 which illustrates a preferred embodiment of the present invention comprising a receptacle 10 operative for holding a viscous mass and for providing intermittent storage of an implement for spreading the viscous mass upon a surface. In accordance with the teachings of the present invention, the viscous mass may include paint, varnish, polyurethane or other viscous mass normally applied to a surface by virtue of a brush, a roller, or other implement operative for allowing a user to spread the viscous mass upon a selected surface. Receptacle 10 is also particularly useful for allowing a user to remove an excess amount of viscous mass from the implement during use.

As shown in FIG. 1, and preferably constructed of plastic, metal or other like substance, receptacle 10 includes a continuous sidewall 11 having a closed lower end 12 and extending upwardly therefrom and terminating with a primary rim 13 defining an opening 14 communicating with a chamber 15 bound by continuous sidewall and operative for holding a viscous mass 16 such as paint, varnish, polyurethane or other viscous mass. In accordance with conventional practice, receptacle 10 may also include a pouring spout 17 and a handle 18, although these features are not essential.

Figure 2:
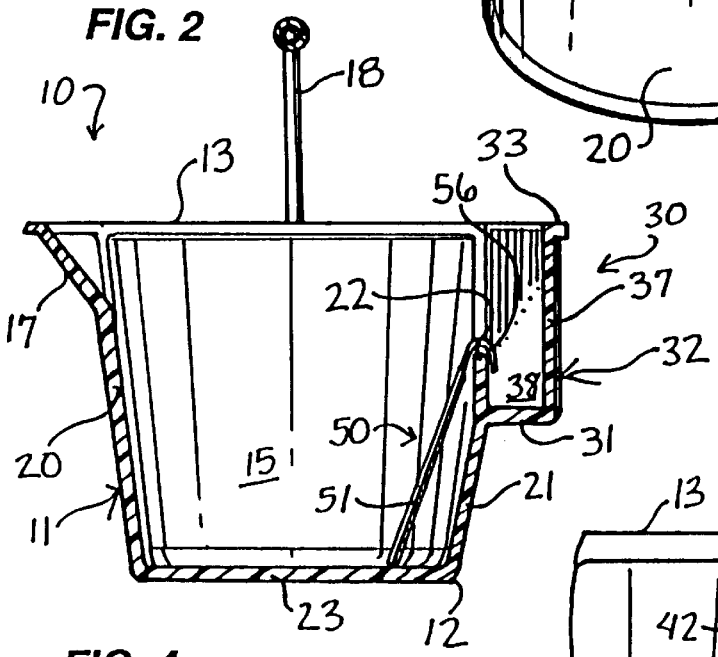
FIG. 2 is a vertical sectional view taken along line 22 of FIG. 1.
Figure 3:
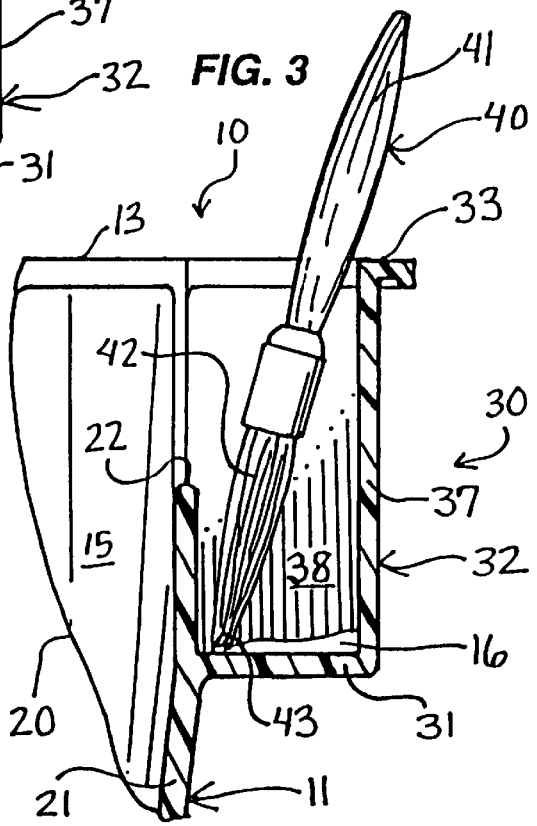
FIG. 3 is a vertical sectional view of an auxiliary container of the receptacle of FIG. 1, in accordance with a preferred embodiment of the present invention.

With additional reference to FIG. 2, illustrating a vertical sectional view taken along line 2—2 of FIG. 1, continuous sidewall 11 includes a primary sidewall 20 having primary rim 13 and a secondary sidewall 21 having a secondary rim 22 located at a point subjacent primary rim 13, primary sidewall 20 and secondary sidewall 21 extending upwardly from a bottom panel 23 of receptacle 10 defining closed lower end 12 and cooperating together to bound chamber 15. As shown in FIG. 2 and FIG. 3, it is seen that primary sidewall 20 is generally cylindrical and secondary sidewall 21 is substantially planar, although this is not essential and other shapes may be used.

Figure 4:
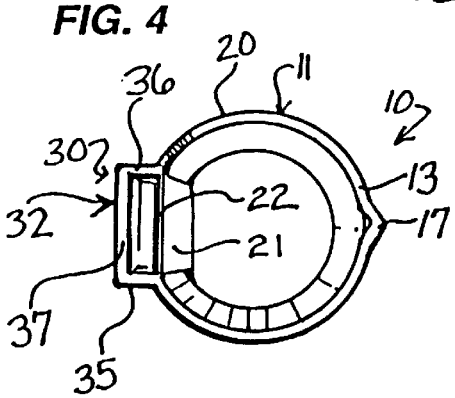
FIG. 4 is a top plan view of the receptacle of FIG. 1, in accordance with a preferred embodiment of the present invention.
Figures 5, 6:
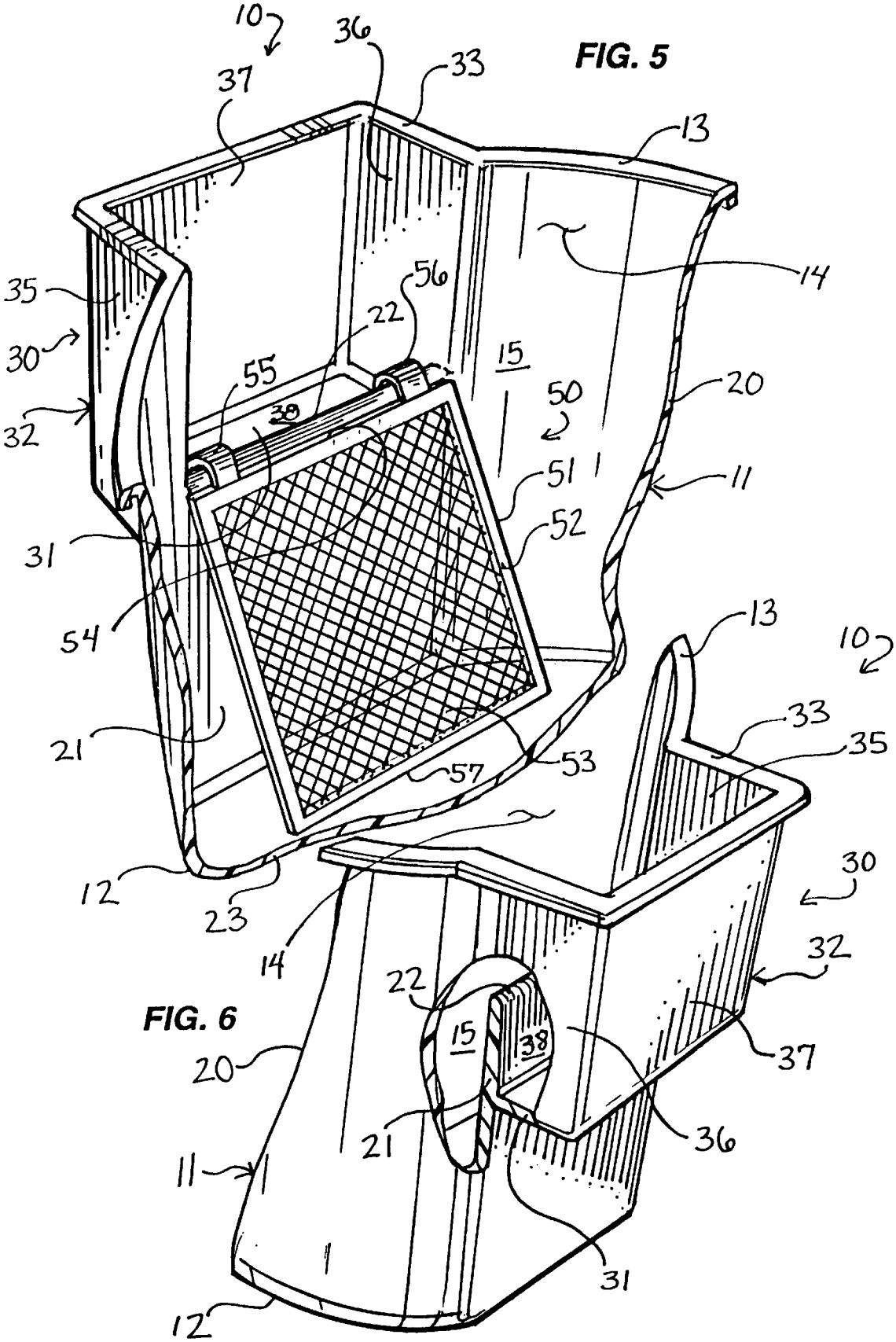
FIG. 5 is a fragmented perspective view of the receptacle of FIG. 1 and further illustrating a planar screen operative for allowing a user to remove an amount of viscous mass from an implement such as a brush, a roller and the like, in accordance with a preferred embodiment of the present invention.
FIG. 6 is a fragmented perspective view of the receptacle of FIG. 1, in accordance with a preferred embodiment of the present invention.

With continuing reference to FIGS. 1–3, and additional reference to FIGS. 4–6, receptacle 10 further includes, in relevant part, an auxiliary container 30 including a bottom panel 31 extending outwardly from secondary sidewall 21 at a point subjacent secondary rim 22, and an auxiliary sidewall 32 extending outwardly from secondary sidewall 21 and extending upwardly from bottom panel 31 and terminating with an auxiliary rim 33 located at a point superjacent secondary rim 22 proximate primary rim 13. As evidenced in the drawings, primary rim 13 and auxiliary rim 33 are shown as being common, although this is not essential. Auxiliary sidewall 32 includes a pair of spaced apart sidewalls 35 and 36 extending outwardly from secondary sidewall 21 and primary sidewall 20 and terminate with an endwall 37 spaced from secondary panel 21, sidewalls 35 and 36 and endwall 37 extending upwardly from bottom panel 31 and terminating with auxiliary rim 33. Bottom panel 31 and portions of sidewalls 35 and 36, endwall 37 and secondary sidewall 21 subjacent secondary rim 22 cooperate together to define a well 38 communicating with chamber 15, with secondary sidewall 21 being common to chamber 15 and well 38. Bottom panel 31, sidewalls 35 and 36 and endwall 37 are each preferably substantially planar, although this is not essential.

With specific attention to FIG. 3, and as herein previously intimated, auxiliary container 30 is preferably operative for holding an implement for spreading viscous mass 16 upon a surface such as a roller or perhaps a brush 40. Auxiliary container 30 may be constructed of varying sizes suitable for holding brushes and rollers of varying sizes and shape. In regard to the present discussion, brush 40 is conventional and includes a handle 41 having bristles 42 depending therefrom and terminating with a lower end 43. Brush 40 may be stored in auxiliary container 30 with lower end 43 of bristles 42 retained within viscous mass 16 carried within well 38 so as to prevent bristles 42 from drying out when not in use. In this manner, a user may introduce viscous mass 16 into well 38 of auxiliary container and store brush 40 therein as described so that bristles 42 will not dry out. Auxiliary container 30 may be constructed of a specified depth so that when stored therein, handle 41 of brush 40, or a handle of a roller or other implement, extends upwardly from auxiliary rim 33 so as to be easily accessible by a user.

Prior to use, excess viscous mass 16 may be removed from bristles 42 by wiping bristles 42 along secondary rim 22 with the excess viscous mass 16 falling into chamber 15. Excess viscous mass 16 may alternatively be removed from bristles 42 by wiping bristles 42 along auxiliary rim 22 with the excess viscous mass 16 falling into well 38 of auxiliary chamber 30.

With attention directed to FIG. 2 and FIG. 5, the present invention may further include a viscous mass removing element 50 suitable for removing excess viscous mass 16 from a brush or a roller. In this regard, viscous mass removing element 50 includes a planar screen 51 including a continuous rim 52 bounding an opening within which is retained a lattice or screen material 53 constructed of a selected metal, plastic or other suitable material. Planar screen 52 further includes an upper edge 54 having a pair of hooks 55 and 56 operative for detachably engaging secondary rim 22 when within chamber 15, with planar screen 52 extending downwardly from secondary rim 22 and terminating with a lower edge 57 to bear against bottom panel 23 defining closed lower end 12 of receptacle 10 at a point spaced from secondary sidewall 21. In this manner of orientation, prior to use, a user may grasp an implement such as a brush or a roller, dip the implement into viscous mass 16 held either in well 38 of auxiliary container 30 or chamber 15 of receptacle 10, and wipe the implement along planar screen 52 to remove excess viscous mass 16 therefrom. As the excess viscous mass 16 is removed, it will fall through planar screen 52 and into chamber 15.

It will be readily appreciated by those skilled in the art, that receptacle 10 provides for the useful and highly beneficial features of allowing a user to store viscous mass within chamber 15 for easy access thereof by a brush, a roller or other implement, prior to application of the viscous mass to a selected surface. Auxiliary container 30 is highly advantageous for allowing a user to intermittently store a selected implement therein when not in use. In this regard, a user may store viscous mass 16 within well 38 of auxiliary container 30 so that the bristles 42 or a roller carried therein will not dry out when not in use. Because well 38 of auxiliary container 30 and chamber 15 of receptacle 10 share secondary sidewall 21 and are disposed in communicating relation, a user may easily transfer viscous mass 16 to and from well 38 and chamber 15 as specifically desired. Furthermore, as receptacle 10 is preferably integrally formed, it may be easily transported from place to place during use, cleaned and stored.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A receptacle for holding a viscous mass and for providing intermittent storage of an implement for spreading the viscous mass upon a surface, said receptacle comprising:

a continuous sidewall having a closed lower end and extending upwardly therefrom and terminating with a primary rim defining an opening communicating with a chamber bound by said continuous sidewall, said continuous sidewall including a primary sidewall having said primary rim and a secondary sidewall having a secondary rim located at a pointed subjacent said primary rim;

an auxiliary container including a bottom panal extending outwardly from said secondary panel at a point subjacent said secondary rim and an auxiliary sidewall extending outwardly from said secondary sidewall and upwardly from said bottom panel and terminating with an auxiliary rim located at a point proximate said primary rim, wherein said bottom panel and portions of said auxiliary sidewall and said secondary sidewall subjacent said secondary rim define a well communicating with said chamber and for holding the implement; and a viscous mass removing element including an upper edge having means for detachably engaging said secondary rim of said secondary sidewall and extending downwardly therefrom and terminating with a lower edge to bear against said closed lower end of said receptacle at a point spaced from said secondary panel.

2. The receptacle of claim 1, wherein said primary sidewall is generally cylindrical.

3. The receptacle of claim 1, wherein said secondary sidewall is generally planar.

4. The receptacle of claim 1, wherein said auxiliary sidewall includes a pair of spaced apart sidewalls extending outwardly from said secondary sidewall and terminating with an endwall spaced from said secondary panel, said pair of sidewalls and said endwall extending upwardly from said bottom panel and terminating with said auxiliary rim.

5. The receptacle of claim 1, wherein said viscous mass removing element includes a planar screen.

6. The receptacle of claim 1, wherein said means includes a pair of hooks extending upwardly from said upper edge to detachably engage said secondary rim.

* * * * *